United States Patent [19]

Weiss

[11] Patent Number: 4,932,577

[45] Date of Patent: Jun. 12, 1990

[54] FRICTION FEED MEDIA DRIVER FOR A SIGN PLOTTER

[76] Inventor: Frederick S. Weiss, 5249 Woodstone Cir. South, Lake Worth, Fla. 33463

[21] Appl. No.: 234,558

[22] Filed: Aug. 22, 1988

[51] Int. Cl.[5] ..... B65H 20/00

[52] U.S. Cl. ..... 226/101; 226/84; 226/187

[58] Field of Search ..... 226/76, 82, 83, 84, 226/186, 187, 101; 33/18.2; 364/189

[56] References Cited

U.S. PATENT DOCUMENTS

| | | | |
|---|---|---|---|
| 3,550,830 | 12/1970 | Lagogue | 226/187 X |
| 3,985,277 | 10/1976 | Wright | 226/183 X |
| 4,062,021 | 12/1977 | Taylor | 226/84 X |
| 4,467,525 | 8/1984 | Logan et al. | 33/18.2 |
| 4,479,598 | 10/1984 | Mailer et al. | 226/186 X |
| 4,567,491 | 1/1986 | Lawrence | 226/179 X |
| 4,607,837 | 8/1986 | Pierce | 226/186 X |

*Primary Examiner*—Stuart S. Levy
*Assistant Examiner*—Eric P. Dunlap
*Attorney, Agent, or Firm*—Harry W. Barron

[57] ABSTRACT

A friction feed media drive mechanism for a sign plotter includes a front idler roller and a back idler roller positioned under compression against a drive roller. The compression may be selectively applied by the user depending whether a friction feed or pin feed mode of operation is desired. Where the pin feed mode of operation is desired, the compression assembly is released and no compression is applied. The compression assembly includes a compression spring loaded member which fits through an opening in a housing and is selectively secured therein by a securing rod attached to a cam shaped knob. The front idler roller and back idler roller are both attached to a roller holding assembly, which has a groove therein adapted for fitting over the driving pins. The two idler rollers extend below the surface of the attaching assembly and may have a hard plastic sleeve on the ends thereof to reduce bending. The attaching assembly is rotatably mounted to a pivoting member which permits the two idler rollers to be positioned firmly against the drive roller.

17 Claims, 2 Drawing Sheets

FRICTION FEED MEDIA DRIVER FOR A SIGN PLOTTER

This invention relates to a friction feed media driver and particularly to such driver which is useful in a plotter used to plot characters, such as letter and logos, useful in the preparation of a sign.

In the past, one common way of placing a sign on business window, vehicle, or the like, has been to utilize vinyl letters or designs which have been cut from a sheet of vinyl material. One machine which may be used to cut the letters and designs is the Graphix 4B manufactured by Gerber Scientific Products Inc. of Manchester, Conn. The user of the Graphix 4B system types in the letters and spacing desired and the machine automatically cuts these letters in the vinyl media, which consists of a layer of vinyl material over a backing material. The cutting is accomplished by moving the vinyl media forward and backward through the machine while at the same time moving a cutting blade laterally across the moving vinyl strip. The cutting blade is additionally capable of rotating at the same time to permit cutting the curve portion of letters.

A major limitation of the Graphix 4B system is that the vinyl media can only be moved forward and backward using a pin feeding driver mechanism. Thus, only vinyl media having a predefined width and pre-punched holes along the edge thereof may be utilized. The pin feeding mechanism was thought to be necessary in order to maintain proper alignment for the letters being cut while feeding the vinyl media forward and backward through the machine. Unfortunately, in many circumstances a particular cutting may be long and narrow, relative to the width of the vinyl media, and in this event, a substantial amount of vinyl media becomes waste and can not be used with Graphix 4B system.

It would be advantageous to the user of a Graphix 4B type system, or other similar system, to be able to utilize the scrap vinyl media for creating letters and designs in addition to the full width pin feed vinyl media. To achieve this advantage would require a modification to the pin feed driver system to permit it to additionally function as a friction feed driver system. When modifying the original pin feed design, one may utilize the fact that the roller platen and feeding pin are a common element.

However, one must first solve the problem of friction feeding a very smooth material, such as the vinyl media used to make sign letters and designs, through the plotter with sufficient precision and accuracy to permit characters and designs to be cut. In the past, the friction feeding of paper documents through typewriters, computer printers and plotters was well known. However, paper has a rough surface compared to the vinyl media and is more easily adapted to a friction feeding system. With vinyl, or other smooth materials, the feeding rollers have difficulty preventing slippage of the material when reversing the feeding direction.

Another problem with friction feeding is maintaining registration when moving the material in opposite directions. Long reverse movements are many times required when cutting letters or designs on vinyl material to be used with signs. Each time a reversing of direction occurs, any slight slippage can cause a loss of registration later. Any practical friction feeding system must solve this registration problem.

In accordance with one aspect of this invention, there is provided an improvement in a plotter of the type in which a media having a specific width and feeding pins on the edges thereof is moved in a forward and backward direction past a plotting mechanism. The plotter includes a round platen having pin feeding means on the edges and means for rotating the platen for removing the media when the hole are aligned with the pins. The improvement is a friction feeding mechanism affixed to the plotter and comprises means for positioning a pair of friction idler roller over the platen on opposite sides of the plotting mechanism and means for applying a force against the means for positioning sufficient to permit a sheet of media having a width less than the specific width to be fed between the idler rollers and the platen past the plotting mechanism.

One preferred embodiment of the subject invention is hereafter described, with specific reference being made to the following Figures, in which.

Figure 1:
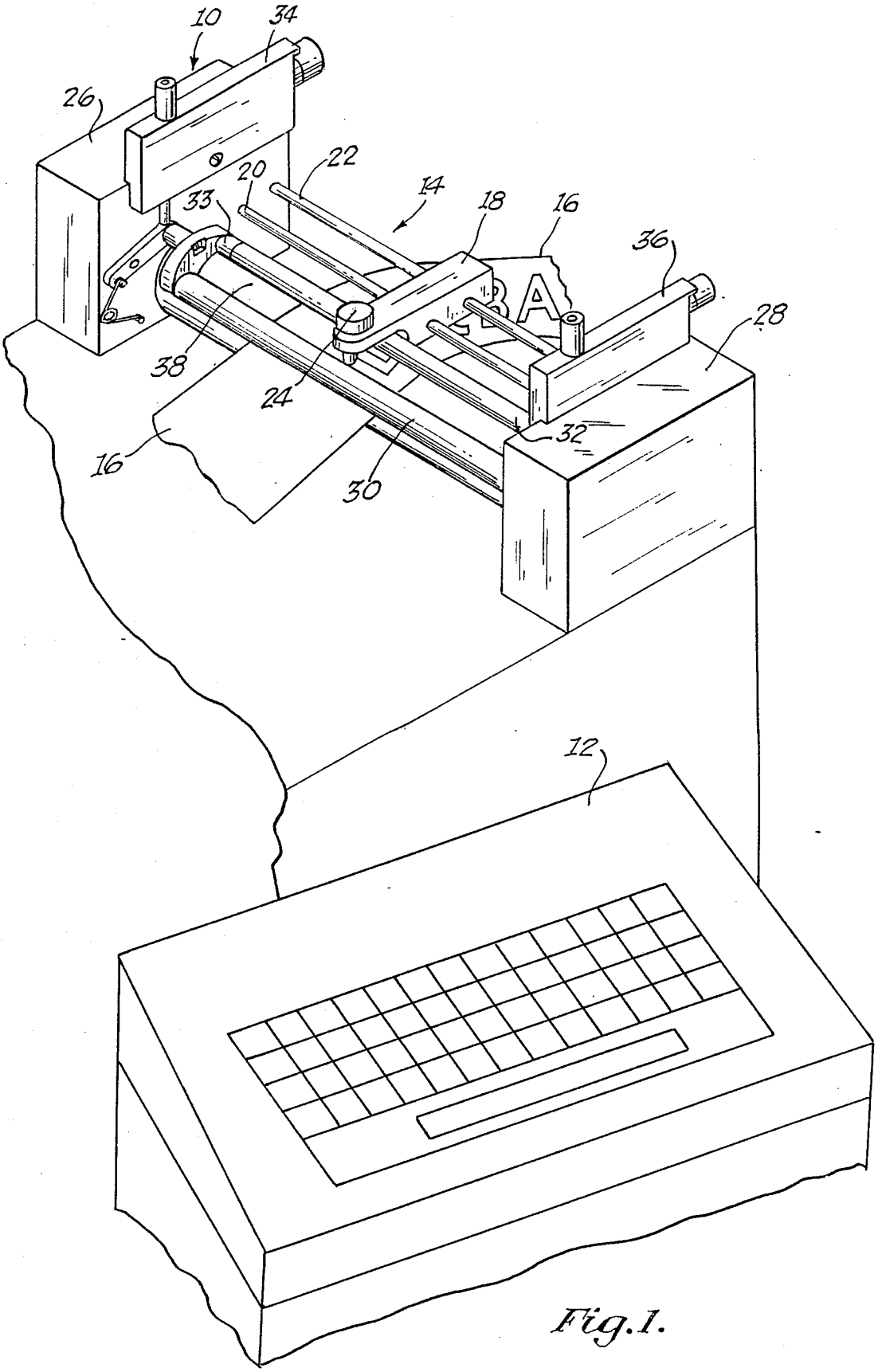
FIG. 1 shows a perspective view of a plotter used to cut letter from a vinyl strip having the friction feeding invention hereof attached thereto.

Referring now to FIG. 1, a conventional sign letter and design plotter 10 is shown, as modified with the friction feed mechanism of the subject invention. Plotter 10 includes a keyboard 12 for inputting data to the plotter to determine how the characters are cut. In addition, plotter 10 includes a media feeding section 14, through which the vinyl media 16 is fed while being cut by a cutter 18. Cutter 18 is moveable from side to side along guide rails 20 and 22 and includes a cutter blade 24 which is independently rotatable.

Media 16 may be a vinyl material on the side facing upward with a conventional backing material, such as a wax paper on the downward facing side thereof. Media 16 may come in a full width sheet which fits substantially between the two end members 26 and 28 or it may be a scrap material, such as shown in FIG. 1, having a width less than the distance between end member 26 and 28. Where media 16 is full width, it will have pre-punched holes on the edges thereof to be fed by a conventional pin feeding mechanism (described hereafter).

Media 16 is moved forward and backward across cutter 24 while at the same time cutter 24 moves from side to side along rails 20 and 22 and rotates. In this manner various different shapes of letters or other figures can be cut in the vinyl to a depth of the backing material.

Plotter 10, as previously mentioned may be modified Graphix 4B system manufactured and sold by Gerber Scientific Products, Inc. of Manchester, Conn. The unmodified Graphix 4B system is adapted to receive only the full width media 16 and to feed media 16 therethrough using only the feeding pin type drive system.

The Graphix 4B system has been modified to permit a scrap of media 16, which does not have the pin holes on both sides thereof and which is less than the full width between end member 26 and 28, to be fed past cutter 24 by a friction feeding mechanism.

In order to accomplish the function of friction feeding, the original idler roller assembly from the Graphix 4B system is removed and replaced by a front idler roller 30 and a back idler roller 32. In addition, compression mechanisms 34 and 36 are attached to the end members 26 and 28. Each of the front and back idler rollers 30 and 32 are made of a soft high friction material, such as unhardened rubber, and are provided with a downward force from compression mechanism 34 and 36 so as to be firmly positioned against the drive roller 38 of plotter 10. Drive roller 38, on the other hand, is fabricated of a hard rubber material, so that the actual gripping of the vinyl material 16 is done by the idler rollers 30 and 32.

As drive roller 38 is rotated by a mechanism (not shown) within plotter 10, the vinyl media 16 placed between the two idler rollers 30 and 32 and the drive roller 38 is moved in a forward or reversed direction, depending upon the direction of movement of the drive roller 38. The interaction between front idler roller 30 and drive roller 38 operates to pull media 16 in the reverse direction and interaction between back idler roller 32 and drive roller 38 operates to pull media 16 in a forward direction. The interaction of the two different roller sets 30–38 and 32–38, together with the pressure from compression mechanisms 34 and 36, maintains media 16 aligned between the idler rollers 30 and 32. As seen in FIG. 1 the cutting blade 24 of cutter 18 is positioned between front idler roller 30 and back idler roller 32.

If it is desired to use a full sheet of vinyl media with the holes along the edges thereof, the pressure provided by compression mechanisms 34 and 36 is released, in the manner described hereafter, and the full sheet of vinyl media 16 is aligned with the pins (not shown in FIG. 1). At this point the plotter operates exactly as the unmodified plotter previously described.

Figure 2:
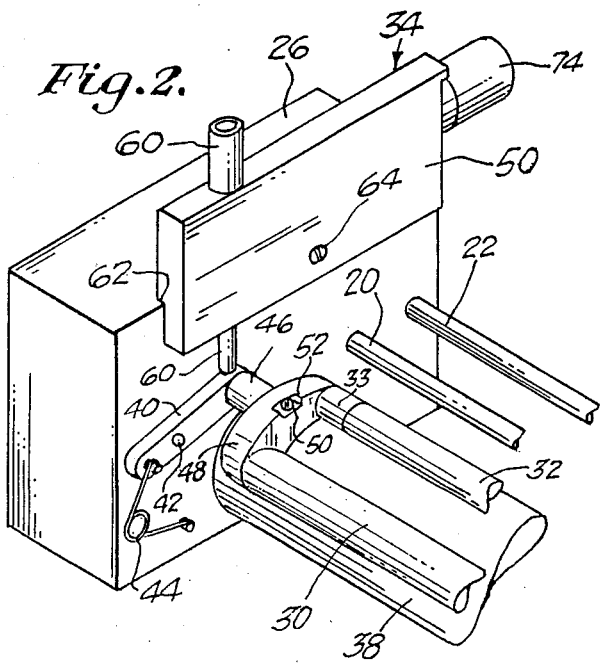
FIG. 2 is a more detailed prospective view of one portion of the plotter shown in FIG. 1.
Figure 4:
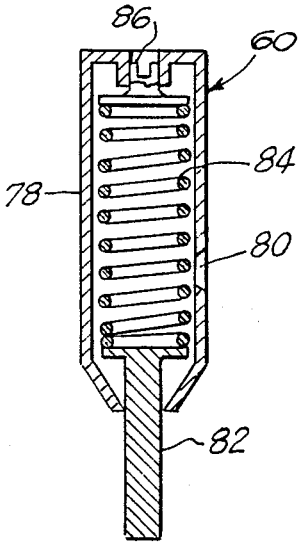
FIG. 4 is a view, partially in cut-a-way, of the pressure applying means for applying pressure on the upper rollers of the plotter shown in FIG. 1.
Figure 5:
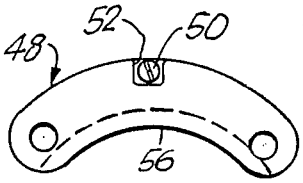
FIG. 5 is a view of the roller holder and pin cover used with the plotter shown in FIG. 1.
Figure 6:
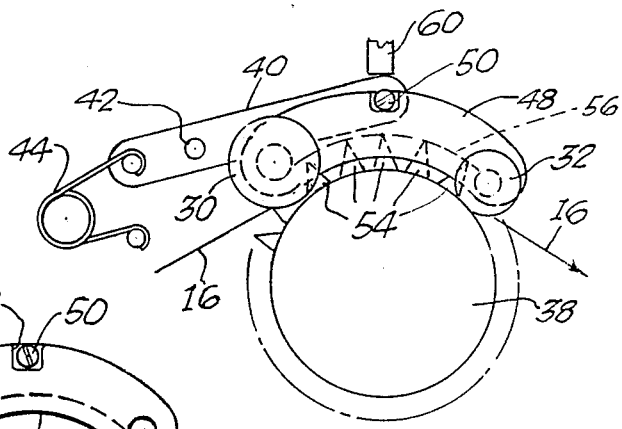
FIG. 6 is a schematic representation of the manner in which the various components fit together.

Referring now to FIGS. 2–6, the detail mechanisms of the subject invention will now be described. Referring specifically to FIGS. 2 and 6, a pivoting member 40 is affixed to end member 26 by a pin 42 and pivots around pin 42. Pivoting member 40 further includes an extension 46 from the end thereof remote from pin 42. Pivoting member 40 is held generally in a downward position by a spring 44 attached between end member 26 and pivoting member 40. Pivoting member 40, pin 42 and spring 44 are the existing components associated with the unmodified plotter 10.

The idler roller affixation member originally affixed to extension 46 of pivoting member 40 is removed and replaced with idler roller attachment assembly 48, as seen in FIGS. 2, 5 and 6. It should be understood that the components affixed to end member 28 are identical to those shown and described in FIG. 2 associated with end member 26. Assembly 48 is attached to extension 46 by a pin 50 so as to rotate about pin 50. Pin 50 is positioned in a recess 52 in assembly 48 so as not to interfere with any vinyl media 16 passing therethrough.

Attached to and extending below idler roller attachment assemblies 48 are the front roller 30 and back roller 32. Both rollers 30 and 32 must extend below the bottom of assembly 48, so that they can be in firm contact with drive roller 38. As seen in FIGS. 1 and 2, back idler roller 32 has a significantly smaller diameter than front idler roller 30 and the reason for this is dictated by the space available to permit movement of cutter blade 24. By providing pivoting member 40 to pivot around pin 42, as well as permitting assembly 48 to rotate about pin 50, both front roller 30 and back roller 32 can be placed in firm contact against drive roller 38.

Due to the small diameter of back roller 32, it may bend whenever a narrow strip of vinyl material 16 is placed in the center of feeding section 14, due to the pressure forces applied to the ends thereof. To prevent this bending, a hard plastic material sleeve 33 is placed on each end of back roller 32. The diameter of the ends of back roller 32 are reduced to receive sleeve 33 and sleeve 33 is sized so that the outer surface of sleeve 33 is even with the remaining soft rubber surface of back roller 32. With the addition of sleeve 33, a hard surface to hard surface contact exists at each end of back roller 32, thereby reducing the tendency of back roller 32 to bend in the middle. A sleeve similar to sleeve 33 may also be used for front roller 30; however since front roller 30 has a larger diameter, it will not bend and such a similar sleeve may not be necessary.

The ends of drive roller 38 include a series of feeding pins 54, which are shown in FIG. 6. It should be understood that the feeding pins 54 extend around the entire circumference of drive roller 38, although only three pins 54 are shown in FIG. 6 in order to avoid clutter. The underside of assemblies 48 each include a groove 56 which fits over feeding pins 54 such that feeding pins 54 pass through groove 56 without interfering with assembly 48. It should be noted that the top portion of groove 56 is held above each of pins 54 due to the front and back idler rollers 30 and 32 contacting drive roller 38.

Figure 3:
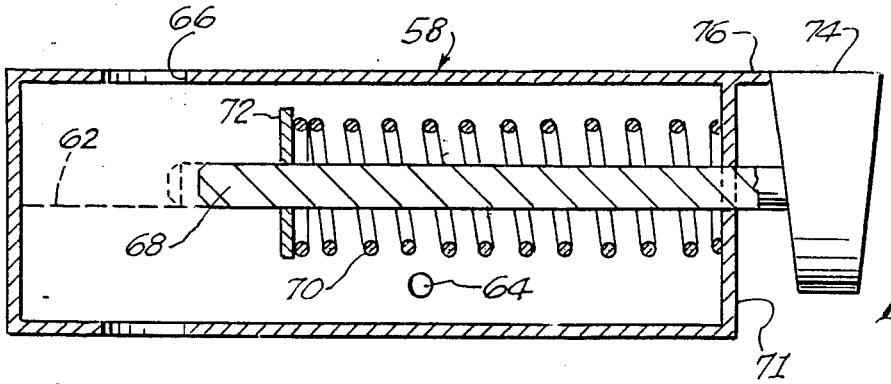
FIG. 3 is a view, partially in cut-a-way, of the pressure applying housing used with the plotter shown in FIG. 1.

When it is desired to use the feeding assembly shown in FIGS. 1 and 2 as a friction feed system, it is necessary to provide a downward force to cause front and back rollers 30 and 32 to be in firm contact with driver roller 38. This force is provide by compression mechanisms 34 and 36, each of which includes a housing 58 and a compression pin 60, details of which are shown in FIGS. 3 and 4 respectfully. Since the feeding mechanism is designed to be utilized either as a friction feed mechanism or a pin feed mechanism, the compression pin 60 must selectively apply or not apply the downward compression force depending on the usage. It is seen from FIG. 2 that pin 60 is positioned against pivoting member 40 to provide the downward force thereagainst. This force is translated through extension 46 and assemblies 48 to the rollers 30 and 32.

Referring now to FIGS. 3 and 4, the detail mechanism of housing 58 and compression pin 60 will now be described. Housing 58 includes a lip 62 adapted to fit over the edge end member 26. Housing 58 is secured to end member 26 by a bolt 64 in the area below lip 62. An opening 66 is provided toward the front end of housing 58 and aligned above the junction of pivoting member 40 and extension 46 so as to be in contact with pivoting member 40. The compression pin 60, shown in FIG. 4, is inserted through opening 66.

Within housing 58, a securing pin 68 is positioned and held under tension by a spring 70 positioned between stop 72 and the end 71 of housing 58 opposite hole 66. Securing pin 68 exits the end 71 of housing 58 and has a cam shaped knob 74 attached thereto. Cam shape knob 74 rides against extension 76 extending from the end 71 of housing 58 such that as knob 74 is rotated, securing pins moves forward into opening 66. Further rotating of knob 74 removes securing pin 68 from opening 66 to the position shown in FIG. 3.

Referring to FIG. 4, compression pin 64 includes a housing 78 having an opening 80 therein. Opening 80 is sized to receive the tip of securing pins 68 when housing 78 is inserted through opening 66 when opening 80 is aligned with pin 68. Extending from housing 78 of compression pin 60 is a pin 82 which is biased downward by a strong spring 84 force within housing 80. A set screw assembly 86 is provided at the top of housing 78 to adjust the tension on spring 84 to provide the proper amount of downward bias force by pin 82. The length of pin 82 and the position of opening 80 are selected so that when securing pin 68 is positioned within opening 80, pin 82 is firmly against pivoting member 40 and spring 84 is compressed. This provides a biasing force downward against pivoting member 40 and holds rollers 30 and 32 firmly against drive roller 38.

When securing pin 68 is disengaged from opening 66, that is moved to the position shown in FIG. 3, compression pin 60 rides freely within openings 66 and exerts very little pressure against pivoting member 40. In this instance, the pins 54 affixed to drive roller 38 may be utilized to drive the vinyl media 16 through plotter 10. When a scrap of media 16, not having the driving holes on both sides, is desired to be used with plotter 10, compression pin assembly 60 is pressed downward and knob 76 is rotated to permit pins 68 to be engaged in opening 80. This maintains the downward force against member 40, which force is translated to downward pressure on idler rollers 30 and 32 against drive roller 38. This downward pressure permits drive roller 38, when rotated, to move the vinyl media 16 forward or backward as necessary.

Figure 7:
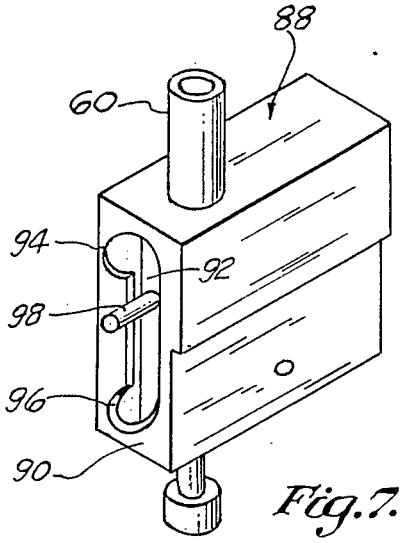
FIG. 7 shows an alternate embodiment of the pressure applying means.

Referring now to FIG. 7, an alternate embodiment of compression mechanism 88 is shown. Compression mechanism 88 differs from compression mechanism 34 in that the front side 90 has a vertical slot 92 with an upper catch 94 and a lower catch 96 at the ends thereof. The two catches 94 and 96 may be circular cuts offset from the ends of slot 92. In addition, opening 80 of pin 60 is threaded and a handle 98 is secured therein after pin 60 is inserted into compression mechanism 88. To use plotter 10 as a pin feeding system, handle 98 is placed in upper catch 94. Whenever it is desired to place pressure on pivoting member 40 in order to use friction feeding for material 16, handle 98 is then manually moved from upper catch 94 to lower catch 96.

What is claimed is:

1. In a plotter of the type in which a media, having a specific width and feeding holes on the edges thereof, is moved in a forward and backward direction past a plotting mechanism, said plotter including a round platen having pin feeding means on the edges and means for rotating said platen for moving said media when the holes thereof are aligned with pins in said pin feeding means the improvement of a friction feeding mechanism for affixation to said plotter comprising:

means for positioning a pair of friction idler rollers over said platen, said idler rollers being positioned on opposite sides of said plotting mechanism;

means for applying a force against said means for positioning sufficient to permit a sheet of media, having a width less than said specific width, to be fed between said idler rollers and said platen past said plotting mechanism;

wherein said means for positioning includes a pair of members, each member having a groove therein and positioned over said pins, each member having said pair of idler rollers attached thereto, and each member receiving said force applied by said means for applying a force; and wherein at least one of said idler rollers has a hard material sleeve on each end thereof aligned with the remainder of said idler roller.

2. The invention according to claim 1 wherein said pair of idler rollers are attached to said member so as to extend below the side thereof facing said pins.

3. The invention according to claim 2 wherein each of said members are pivotally and rotatably affixed to said plotter.

4. The invention according to claim 1 wherein each of said members are pivotally and rotatably affixed to said plotter.

5. The invention according to claim 1 wherein said means for applying a force includes means for selectively applying said force when said media is either less than said specific width or does not have said holes on both sides thereof and for being set to apply no force when said media is said specific width and has said holes on both sides thereof.

6. The invention according to claim 5 wherein said means for applying a force includes user operable means for selectively applying said force.

7. In a plotter of the type in which a media, having a specific width and feeding holes on the edges thereof, is moved in a forward and backward direction past a plotting mechanism, said plotter including a round platen having pin feeding means on the edges and means for rotating said platen for moving said media when the holes thereof are aligned with pins in said pin feeding means the improvement of a friction feeding mechanism for affixation to said plotter comprising:

means for positioning a pair of friction idler rollers over said platen, said idler rollers being positioned on opposite sides of said plotting mechanism;

means for applying a force against said means for positioning sufficient to permit a sheet of media, having a width less than said specific width, to be fed between said idler rollers and said platen past said plotting mechanism;

wherein said means for applying a force includes means for selectively applying said force when said media is either less than said specific width or does not have said holes on both sides thereof and for being set to apply no force when said media is said specific width and has said holes on both sides thereof;

wherein said means for applying a force includes user operable means for selectively applying said force; and wherein said means for applying a force includes a spring loaded member and a holder, said spring loaded member including a hole therein and said holder including a positioning rod alternately fitting within said hole to position said spring loaded member against said means for positioning against the bias of said spring loaded member, and removed from said hole thereby removing said bias.

8. The invention according to claim 7 wherein said rod includes a cam shaped knob for moving said rod into a position to engage said hole or away from said position to disengage said hole.

9. The invention according to claim 7 wherein said means for positioning includes a pair of members, each member having a groove therein and positioned over said pins, each member having said pair of idler rollers attached thereto, and each member receiving said force applied by said means for applying a force.

10. The invention according to claim 9 wherein said pair of idler rollers are attached to said member so as to extend below the side thereof facing said pins.

11. The invention according to claim 10 wherein at least one of said idler rollers has a hard material sleeve on each end thereof aligned with the remainder of said idler roller.

12. The invention according to claim 10 wherein each of said members are pivotally and rotatably affixed to said plotter.

13. The invention according to claim 9 wherein each of said members are pivotally and rotatably affixed to said plotter.

14. In a plotter of the type in which a media, having a specific width and feeding holes on the edges thereof, is moved in a forward and backward direction past a plotting mechanism, said plotter including a round platen having pin feeding means on the edges and means for rotating said platen for moving said media when the holes thereof are aligned with pins in said pin feeding means the improvement of a friction feeding mechanism for affixation to said plotter comprising:

means for positioning a pair of friction idler rollers over said platen, said idler rollers being positioned on opposite sides of said plotting mechanism;

means for applying a force against said means for positioning sufficient to permit a sheet of media, having a width less than said specific width, to be fed between said idler rollers and said platen past said plotting mechanism;

wherein said means for applying a force includes means for selectively applying said force when said media is either less than said specific width or does not have said holes on both sides thereof and for being set to apply no force when said media is said specific width and has said holes on both sides thereof;

wherein said means for applying a force includes user operable means for selectively applying said force; and wherein said means for applying a force includes a casing having a slot and a pair of catch means and said means for applying a force further includes a spring loaded member and a holder, said spring loaded member including a handle extending through said slot and positionable in one of said catch means for positioning said spring loaded member against said means for positioning against the bias of said spring loaded member.

15. In a plotter of the type in which a media, having a specific width and feeding holes on the edges thereof, is moved in a forward and backward direction past a plotting mechanism, said plotter including a round platen having pin feeding means on the edges and means for rotating said platen for moving said media when the holes thereof are aligned with pins in said pin feeding means the improvement of a friction feeding mechanism for affixation to said plotter comprising:

means for positioning a pair of friction idler rollers over said platen, said idler rollers being positioned on opposite sides of said plotting mechanism;

means for applying a force against said means for positioning sufficient to permit a sheet of media, having a width less than said specific width, to be fed between said idler rollers and said platen past said plotting mechanism;

wherein said means for applying a force includes means for selectively applying said force when said media is either less than said specific width or does not have said holes on both sides thereof and for being set to apply no force when said media is said specific width and has said holes on both sides thereof;

wherein said means for positioning includes a pair of members, each member having a groove therein and positioned over said pins, each member having said pair of idler rollers attached thereto, and each member receiving said force applied by said means for applying a force;

wherein each of said members are pivotally and rotatably affixed to said plotter;

wherein said means for applying a force includes user operable means for selectively applying said force; and wherein said means for applying a force includes a spring loaded member and a holder, said spring loaded member including a hole therein and said holder including a positioning rod alternately fitting within said hole to position said spring loaded member against said means for positioning against the bias of said spring loaded member, and removed from said hole thereby removing said bias.

16. The invention according to claim 15 wherein said rod includes a cam shaped knob for moving said rod into a position to engage said hole or away from said position to disengage said hole.

17. In a plotter of the type in which a media, having a specific width and feeding holes on the edges thereof, is moved in a forward and backward direction past a plotting mechanism, said plotter including a round platen having pin feeding means on the edges and means for rotating said platen for moving said media when the holes thereof are aligned with pins in said pin feeding means the improvement of a friction feeding mechanism for affixation to said plotter comprising:

means for positioning a pair of friction idler rollers over said platen, said idler rollers being positioned on opposite sides of said plotting mechanism;

means for applying a force against said means for positioning sufficient to permit a sheet of media, having a width less than said specific width, to be fed between said idler rollers and said platen past said plotting mechanism;

wherein said means for applying a force includes means for selectively applying said force when said media is either less than said specific width or does not have said holes on both sides thereof and for being set to apply no force when said media is said specific width and has said holes on both sides thereof;

wherein said means for positioning includes a pair of members, each member having a groove therein and positioned over said pins, each member having said pair of idler rollers attached thereto, and each member receiving said force applied by said means for applying a force;

wherein each of said members are pivotally and rotatably affixed to said plotter;

wherein said means for applying a force includes user operable means for selectively applying said force; and wherein said means for applying a force includes a casing having a slot and a pair of catch means and said means for applying a force further includes a spring loaded member and a holder, said spring loaded member including a handle extending through said slot and positionable in one of said catch means for positioning said spring loaded member against said means for positioning against the bias of said spring loaded member.

* * * * *